US009446596B2

(12) United States Patent
Suzuki

(10) Patent No.: US 9,446,596 B2
(45) Date of Patent: Sep. 20, 2016

(54) INKJET PRINTER

(71) Applicant: OKI DATA INFOTECH CORPORATION, Chiba-shi, Chiba (JP)

(72) Inventor: Kazuo Suzuki, Chiba (JP)

(73) Assignee: Oki Data Infotech Corporation, Chiba-shi, Chiba (JP)

( * ) Notice: Subject to any disclaimer, the term of this patent is extended or adjusted under 35 U.S.C. 154(b) by 0 days.

(21) Appl. No.: 14/773,818

(22) PCT Filed: Apr. 30, 2014

(86) PCT No.: PCT/JP2014/061937

§ 371 (c)(1),
(2) Date: Sep. 9, 2015

(87) PCT Pub. No.: WO2014/203629

PCT Pub. Date: Dec. 24, 2014

(65) Prior Publication Data

US 2016/0114599 A1 Apr. 28, 2016

(30) Foreign Application Priority Data

Jun. 20, 2013 (JP) ..... 2013-129663
Feb. 19, 2014 (JP) ..... 2014-029988

(51) Int. Cl.

| | |
|---|---|
| ***B41J 29/13*** | (2006.01) |
| ***B41J 2/17*** | (2006.01) |
| ***B41J 2/175*** | (2006.01) |
| ***B41J 29/377*** | (2006.01) |

(52) U.S. Cl.
CPC ..... *B41J 2/1714* (2013.01); *B41J 2/175* (2013.01); *B41J 29/13* (2013.01); *B41J 29/377* (2013.01)

(58) Field of Classification Search
CPC ..... B41J 2/1714
See application file for complete search history.

(56) References Cited

U.S. PATENT DOCUMENTS

2013/0215194 A1* 8/2013 Leoni ..... B41J 2/1652 347/34

FOREIGN PATENT DOCUMENTS

JP 6246910 9/1994
JP 2013107330 * 6/2013 ..... B41J 2/01

OTHER PUBLICATIONS

International Search Report mailed Aug. 5, 2014, issued in International Application No. PCT/JP2014/061937.

* cited by examiner

*Primary Examiner* — Julian Huffman
(74) *Attorney, Agent, or Firm* — Muncy, Geissler, Olds & Lowe, P.C.

(57) ABSTRACT

In an inkjet printer, there has been a problem in that a recording medium is charged with electricity due to friction and separation at the time of conveyance of the recording medium, and ink mist is attracted to a portion charged with electricity to have an unexpected pattern to be recorded. In view of this problem, static electricity generated on the recording medium is removed by providing a carriage with an ionizer for generating a positive ion and an ionizer for generating a negative ion and generating the ions at the time of scan of the carriage. Through the arrangement of the ionizers for generating the ions of both polarities, namely, the positive ion and the negative ion, on the carriage, and on/off control on the ions to be generated in each scan, an amount of ions to be supplied per unit area of the recording medium can be made uniform, with the result that the static electricity can be removed efficiently.

14 Claims, 10 Drawing Sheets

Fig.10

| TYPE OF RECORDING MEDIUM | FIRST PERIOD | SECOND PERIOD | THIRD PERIOD | FOURTH PERIOD |
|---|---|---|---|---|
| MEDIUM A | 0.7 | 0.8 | 0.9 | 1.0 |
| MEDIUM B | 0.4 | 0.6 | 0.8 | 1.0 |
| MEDIUM C | 0.6 | 0.75 | 0.9 | 1.0 |

INKJET PRINTER

TECHNICAL FIELD

The present invention relates to an inkjet printer.

BACKGROUND ART

There is known an inkjet printer for recording an image or the like by ejecting ink onto a recording medium, such as recording paper and a resin film. In the inkjet printer, an inkjet recording head is used in which a large number of nozzles are arranged on a nozzle surface, and ink is ejected from the nozzles to the recording medium, to thereby record a desired image.

A platen is arranged at a position opposed to the recording head. The recording medium is held on the platen in a planar manner, and the ink is ejected to the held recording medium. The recording medium is conveyed while being nipped by conveyance rollers arranged on an upstream side of the platen. In some cases, the recording medium is charged due to, for example, static electricity generated when the recording medium is separated from the rollers or static electricity generated by friction on the platen or another conveyance path.

Further, ink droplets ejected from the recording head may include not only ink droplets that account for the most part of the ejected ink, but also extremely small particles of scattered ink. Those extremely small particles of scattered ink may float as mist. When the recording medium is charged, this mist may be adhered in a concentrated manner to a portion charged, and the adhered mist may be recorded onto the recording medium to have an unexpected pattern. This pattern is a cause of deterioration of image quality.

For example, in JP 06-246910 A, there is disclosed a printer for printing an object to be printed while moving a printing head relative to the object to be printed, in which static electricity removing means is arranged on an upstream side of the direction in which the printing head and the object to be printed are configured to move relative to each other so as to remove electricity on the object to be printed.

CITATION LIST

Patent Literature

[PTL 1] JP 06-246910 A

SUMMARY OF INVENTION

Technical Problem

In the related-art printer, as the static electricity removing means, there is used an ion air generator for generating ion air for electrically neutralizing the electricity charged on the object to be printed. The ion generator is arranged on the upstream side of the direction in which the printing head and the object to be printed are configured to move relative to each other, and after the electricity is neutralized on the upstream side, the printing is performed with the use of the printing head. Further, an AC corona discharge ionizer is used as the ion air generator, and the generated positive and negative ions are blown out, to the object to be printed together with air.

However, the static electricity removing means of the related-art printer is operated with its power turned on at all times, and hence there occurs a difference in ion supply amount per unit area due to a difference in printing operation of the printer. The difference in printing operation is, for example, a difference in conveyance speed of the recording medium. When there is a difference in ion supply amount per unit area, there occurs such a situation that an ion supply amount is excessive in a given printing operation whereas an ion supply amount is insufficient in a given printing mode. As a result, the static electricity charged on the object to be printed is not neutralized optimally, and the image quality deteriorates depending on the printing mode. Further, when the ion supply amount is excessive, there occurs such a phenomenon that the object to be printed is charged with electricity after absorbing a large amount of specific ions. As a result, there also occurs a problem in that the object to be printed can no longer be conveyed normally because the object to be printed is stuck to a platen or a paper guide due to the static electricity.

The related art has the above-mentioned problems.

Solution to Problem

An inkjet printer according to one embodiment of the present invention has an optimal parameter of an ion supply amount that is associated with each of various printing modes of the printer. Through switching of on and off of an ionizer in each scan of a carriage based on the parameter, an ion supply amount per unit area of an object to be printed is put in an optimal state.

According to one embodiment of the present invention, there is provided an inkjet printer for changing, depending on a printing mode, a conveyance amount and a carriage speed of a recording medium to be conveyed intermittently, ejecting ink from a recording head, and recording an image onto the recording medium, the inkjet printer including: the recording head for ejecting the ink to the recording medium from a plurality of nozzles; conveyance means for conveying the recording medium; a carriage having the recording head mounted therein, the carriage being reciprocable in a direction intersecting with a conveyance direction of the recording medium; a platen arranged so as to be opposed to a surface of the recording head on which the plurality of nozzles are arranged, for holding the recording medium being conveyed by the conveyance means; a housing having at least the platen and the carriage accommodated therein; a first ionizer for generating a positive ion; a second ionizer for generating a negative ion; a first drive circuit for driving the first ionizer; a second drive circuit for driving the second ionizer; control means for controlling the first drive circuit and the second drive circuit; and storage means for storing a parameter for supporting an on operation and an off operation of each of the first ionizer and the second ionizer in association with the printing mode. The first drive circuit and the second drive circuit are controlled by the control means independently of each other. The control means acquires the printing mode of the inkjet printer, acquires the parameter associated with the acquired printing mode from the storage means, and controls, based on the acquired parameter, in each scan of the carriage, the on operation and the off operation of the first ionizer and the second ionizer.

Advantageous Effects of Invention

According the one embodiment of the present invention, it is possible to reduce the sizes and weights of the ionizers and drive circuits mounted to the recording head, and hence, with the selective generation of the ion, it is possible to remove the static electricity of the recording medium efficiently. It is thus possible to record a high-quality image by recording the image onto the recording medium from which the static electricity is removed.

BRIEF DESCRIPTION OF DRAWINGS

FIG. 10 is a table for showing control that is based on each type of recording medium.

DESCRIPTION OF EMBODIMENTS

An embodiment of the present invention is described with reference to the drawings.

Figure 1:
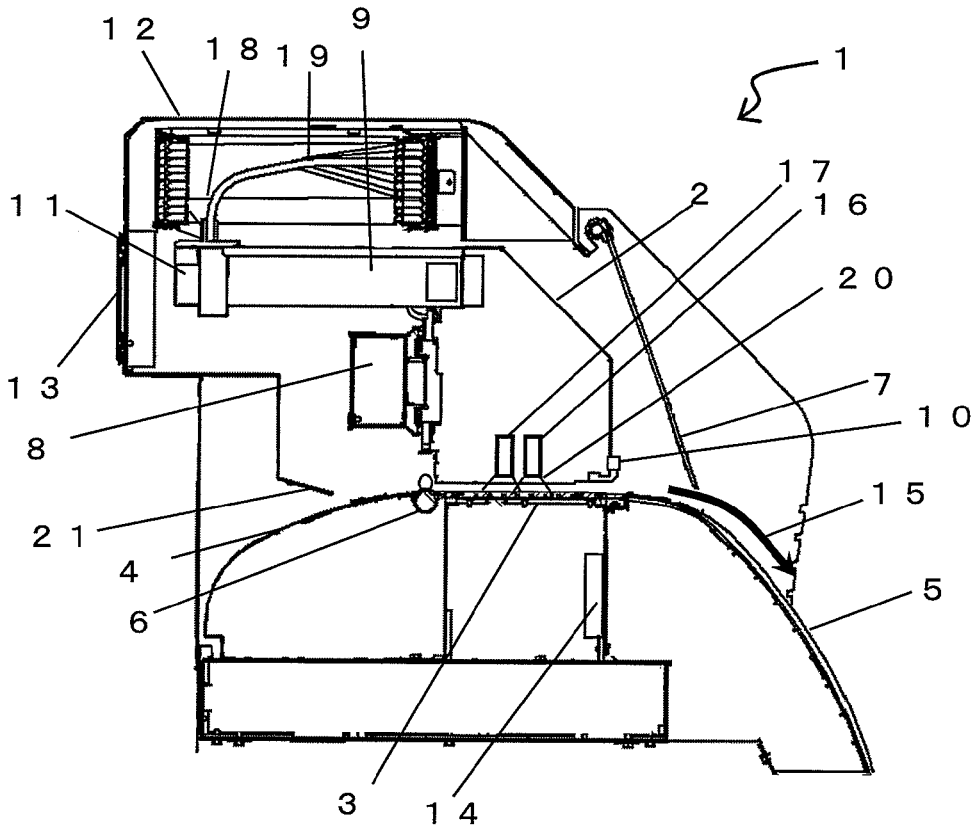
FIG. 1 is a cross-sectional view of an inkjet printer.

FIG. 1 is a cross-sectional view of an inkjet printer. In an inkjet printer 1, a carriage 2 having an inkjet-type recording head mounted therein reciprocates in a depth direction of the drawing sheet. The carriage 2 is movable along a rail 8. A platen 3 is arranged at a position opposed to a nozzle surface of the recording head. The platen 3 is formed of a flat plate, and a large number of through holes are formed in the platen 3. A sealed space is formed below the platen 3, and air is discharged from the sealed space by a suction fan 14. When the air is discharged, air pressure of the sealed space is decreased. The through holes are formed in the platen 3, and hence a recording medium arranged on the platen 3 is attracted thereonto. A large number of nozzles are formed in the nozzle surface of the recording head, and ink is ejected through the nozzles. The ink is ejected depending on a position of the carriage 2, thereby recording a desired image on the recording medium. When the ink is ejected, in addition to ejected droplets that account for the most part of the ejected ink, a slight amount of extremely small particles of ink is scattered. Those extremely small particles of ink float as mist in the air.

A front paper guide 5 is provided on a downstream side of the platen 3 along a conveyance direction of the recording medium, and a rear paper guide 4 is provided on an upstream side thereof. Conveyance rollers 6 are arranged in a portion between the rear paper guide 4 and the platen 3. The recording medium is heated in the rear paper guide 4, and conveyed while being nipped by the conveyance rollers 6 and pinch rollers paired with the conveyance rollers 6. Then, the recording medium is sent to the platen 3, and further delivered along the front paper guide 5. A heater is also provided in each of the platen 3 and the front paper guide 5 so as to heat the recording medium. In this manner, drying of ink adhered to the recording medium is promoted. After the recording medium is pinched between the conveyance roller 6 and a pinch roller paired with the conveyance roller 6, the static electricity is generated in some cases when the recording medium is discharged from the pair of rollers and separated from the rollers. The static electricity generated in this case is a cause of the electricity to be charged on the recording medium. Further, the static electricity is also generated due to friction between a conveyance path and the recording medium, which is another cause of the electricity to be charged on the recording medium.

A bending portion 21 corresponding to a portion at which an end portion of a housing 12 is bent is arranged above the rear paper guide 4 so as to be opposed to the rear paper guide 4. The bending portion 21 is bent toward an inward direction of the housing 12, and is closer to the rear paper guide 4 as approaching a distal end thereof. Further, the distal end portion of the bending portion 21 is arranged so as to be lower than a flat portion on a surface of the platen 3 in a vertical direction. With this, a gas sucked by housing-suction fans 13 arranged on a rear surface of the housing 12 easily flows, even in a small amount, toward the downstream side in the conveyance direction of the recording medium, that is, toward the carriage 2 or a cover 7. In other words, the sucked air is difficult to flow out through a portion between the bending portion 21 and the rear paper guide 4.

The front paper guide 5 is opposed to a distal end of the cover 7 provided above the front paper guide 5. Further, the cover 7 is closer to the front paper guide 5 as approaching a distal end thereof. The front paper guide 5 is curved downward as approaching the downstream side in the conveyance direction of the recording medium. With the cover 7 and the front paper guide 5 configured as described above, the gas inside the housing 12 easily flows along a surface of the front paper guide 5. The heater is arranged in a portion inside the front paper guide 5 on a rear surface side thereof, and the recording medium is heated by the heater, to thereby promote the drying of the ink adhered to the recording medium. In this case, when a solvent that evaporates in the vicinity of a surface of the recording medium stagnates, the drying of the ink is inhibited. Therefore, the stagnation of the solvent is prevented by sending air. The cover 7 is arranged closer to the front paper guide 5 so as to form an air-flow along the front paper guide 5 in a direction indicated by the arrow 15, and is arranged so as to be oriented downward.

A duct 9 is arranged above the carriage 2 so as to extend toward a rear surface of the housing 12. A carriage-suction fan 11 is arranged at an end portion of the duct 9 on a rear surface side of the housing 12. The housing-suction fans 13 and the carriage-suction fan 11 are arranged so as to be opposed to each other.

The duct 9 is arranged at each end in a moving direction of the carriage 2. The carriage-suction fan 11, which serves as carriage-suction means for sucking the gas into the carriage 2, is arranged at a distal end of each duct 9. The gas is sucked by the carriage-suction fan 11, and passes through the duct 9 and an inside of the carriage 2. Then, the gas is discharged to an outside through an exhaust port 10 formed in a side wall of the carriage 2 on the downstream side of the conveyance direction of the recording medium, that is, discharged into the housing 12. The exhaust port 10 is directed to the cover 7, and the discharged gas flows toward the cover 7. The inside of the carriage 2 and a recording head 2 are cooled by the gas flowing inside the carriage 2. The exhaust port 10 is formed into an elongated hole along the moving direction of the carriage 2, that is, along a widthwise direction thereof. It is preferred to form an elongated hole having a width corresponding to arrangement of the recording head of the carriage 2. With this, the gas does not stagnate in the housing 12 to facilitate the discharge of the gas.

In a portion above the duct 9, a flat cable 18 and an ink tube 19 are arranged so as to be routed around this portion. The flat cable 18 and the ink tube 19 are respectively connected to an electric circuit and an ink tank, which are provided outside the carriage 2.

Each housing-suction fan 13 has a height larger than a height of the carriage-suction fan 11, which is twice as large as the height of the carriage-suction fan 11. In other words, as the housing-suction fan 13, a large-sized fan is used so as to suck a large amount of the outside air. The gas sucked into the housing 12 includes a gas that is sucked into the carriage 2 by the carriage-suction fan 11 and a gas that passes through the outside of the carriage 2. The sucked air is directed toward the cover 7 arranged on a front surface of the housing 12. The housing-suction fan 13 is prevented from being blocked by the carriage-suction fan 11, thereby being capable of reducing a sharp change in direction of the air-flow. An upper end of the cover 7 is connected to the housing 12 in a pivotable manner.

Further, the gas discharged from the exhaust port 10 is directed to the cover 7. The cover 7 is inclined, and hence the gas blown onto the cover 7 forms an air-flow along the cover 7 in a downward direction, and further flows along the front paper guide 5. The gas exhausted from the exhaust port 10 is discharged to the outside while being mixed with a gas flowing through the outside of the carriage 2. The gas sucked by the carriage-suction fans 11 flows faster than the gas flowing through the outside of the carriage 2 when discharged from the discharge port 10. Along with the air-flow from the discharge port 10, a gas surrounding the air-flow also flows faster, and hence the gas can be smoothly discharged from a portion between the front paper guide 5 and the cover 7 to the outside. It is possible to promote the discharge of the solvent having evaporated into the gas from the ink stagnating in the housing, and hence the ink can be dried in a shorter period of time.

A first ionizer 16 for generating a positive ion and a second ionizer 17 for generating a negative ion are arranged on a side surface of the carriage 2. The first ionizer 16 and the second ionizer 17 each have an opening in a downward direction, namely, in a direction toward the platen 3, and the ions are discharged from those openings. The ions are mainly discharged in a direction indicated by an irradiation direction 20 of the ions. The ions discharged from the first ionizer 16 and the second ionizer 17 remove the static electricity of the recording medium. As those ionizers, DC ionizers for applying a high DC voltage to an electrode are preferred.

The first ionizer 16 and the second ionizer 17 are arranged at a little distance from each other along the conveyance method direction of the recording medium. The discharged ions are stirred and discharged by the air-flow within the housing 12, but a part of the discharged ions removes the electricity charged on the recording medium.

At the time of recording, the recording medium is conveyed by a distance obtained by dividing a length of the recording head by an integer of two or more, and the recording is performed on the same area a plurality of times. For example, the printing is performed in divided parts about four to twelve times. In a printer using such a recording method, even without the use of an ionizer having a width that covers the entire width of the platen 3, the electricity charged on the recording medium can be removed with the use of the ionizer for discharging the ion within a narrow range. Further, by supplying the ions from the ionizer to the same area the plurality of times, the electricity is removed more securely.

Further, with the use of separate electrodes for the positive ion and the negative ion, the positive ion and the negative ion are recombined to each other less frequently so that the number of ions to reach the recording medium can be increased. It is preferred that a distance between the first ionizer 16 and the second ionizer 17 be about from 5 mm to 20 mm. When the first ionizer 16 and the second ionizer 17 are separated from each other too much, namely, separated from each other by an amount corresponding to a single conveyance of the recording medium, both of the positive ion and the negative ion cannot be supplied to the same area, and only one of the positive ion and the negative ion is supplied to the same area as a result. Thus, the balance between a concentration of the positive ions and a concentration of the negative ions is lost, and hence the charged electricity can no longer be removed suitably as a result. Further, by arranging the first ionizer 16 and the second ionizer 17 close to the recording medium, specifically, by setting a distance from the first ionizer 16 or the second ionizer 17 to the recording medium to from 10 mm to 30 mm, the ions are prevented from being scattered in other directions than a direction toward the recording medium. When the first ionizer 16 and the second ionizer 17 are separated from the recording medium too much, the ions are diffused before reaching the recording medium, and hence the charged electricity cannot be removed. When the first ionizer 16 and the second ionizer 17 are close to the recording medium too much, both of the positive ion and the negative ion cannot be supplied to the same area, and only one of the positive ion and the negative ion is supplied to the same area as a result. Thus, the balance between a concentration of the positive ions and a concentration of the negative ions is lost, and hence the charged electricity can no longer be removed suitably as a result.

Figure 2:
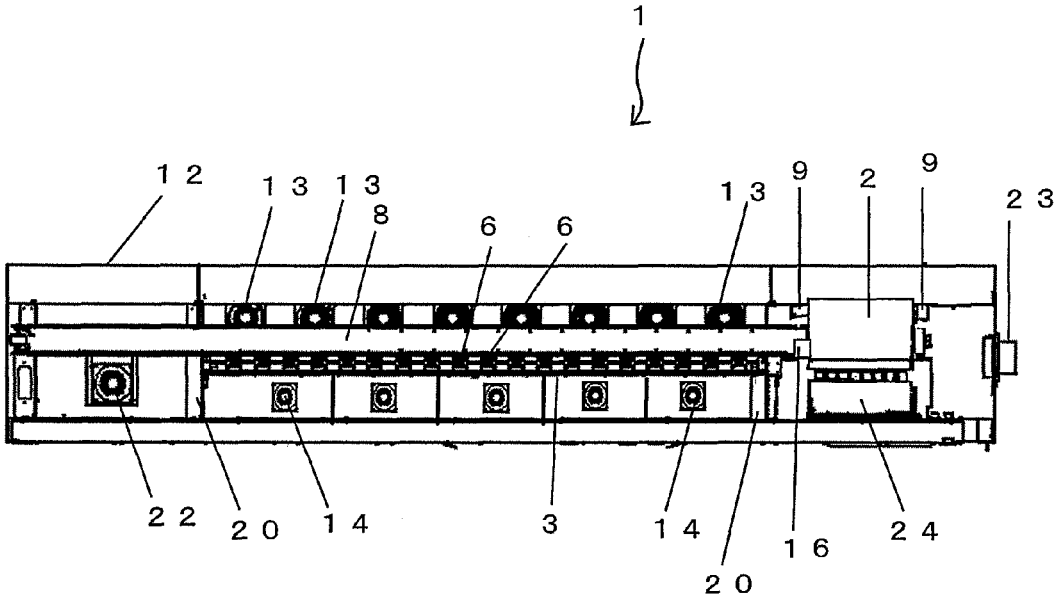
FIG. 2 is an explanatory view of arrangement of suction means and exhaust means in the inkjet printer.

FIG. 2 is an explanatory view of arrangement of suction means and exhaust means in the inkjet printer. A flow of the air in the housing 12 is described with reference to FIG. 2. The gas sucked into the housing 12 is discharged from a housing side surface-exhaust fan 23, a housing rear surface-exhaust fan 22, a portion between the rear paper guide 4 and the bending portion 21, or a portion between the front paper guide 5 and the cover 7, or through the suction by the platen 3. A large number of the housing-suction fans 13 serving as housing-suction means for sucking the gas are arranged on the rear surface of the housing 12 of the inkjet printer 1. The housing-suction fans 13 are arranged along a longitudinal direction of the housing 12. The housing-suction fans 13 are arranged so as to be opposed to the carriage-suction fan 11. This configuration is made to enable sucking a large amount of the air present outside the housing 12 into the carriage 2.

The rail 8 and the platen 3 are also arranged along the longitudinal direction of the housing. The platen 3 is a flat platen, and the large number of through holes are formed in the platen 3. Below the platen 3, there is secured a space partitioned by the platen 3, erecting plates 20 provided below both ends of the platen 3, and the like. A gas in the space is discharged to the outside through the suction fans 14 so as to generate negative pressure, and the recording medium conveyed on the platen 3 is sucked so as to be attracted.

The air flows in the following route. Specifically, the air flows from the housing-suction fans 13 toward the cover 7, and flows downward along the cover 7 to be discharged to the outside through the gap between the front paper guide 5 and the cover 7.

A large number of the conveyance rollers 6 for conveying the recording medium are provided on the upstream side of the platen 3 along the conveyance direction of the recording medium. The conveyance rollers 6 are arranged along a longitudinal direction of the platen 3 at equal intervals. A maintenance unit 24 for the recording heads is provided on one end of the housing 12. The maintenance unit 24 includes a wiper for wiping the nozzle surface of the recording head, and a cap for sucking ink while being held in close contact with the nozzle surface. The housing side surface-exhaust fan 23 is provided on a side surface of the housing 12 on the maintenance unit 24 side so as to exhaust the gas inside the housing 12 to the outside. Further, a space for turning when the carriage 2 reciprocates is secured on a side of the housing 12, which is opposite to the housing side surface-exhaust fan 23 across the platen 3. The housing rear surface-exhaust fan 22 is provided on the rear of the space, that is, the rear surface of the housing 12 so as to exhaust the gas inside the housing 12 to the outside. In this manner, the air is exhausted by the fans, thereby being capable of reducing an amount of the air discharged through the portion between the cover 7 and the front paper guide 5. As a result, cooling of the recording medium can be suppressed in some degree. Further, stirring is also performed by the air-flow so that the ions generated by the first ionizer 16 and the second ionizer 17 impinge on the recording medium.

Figure 3:
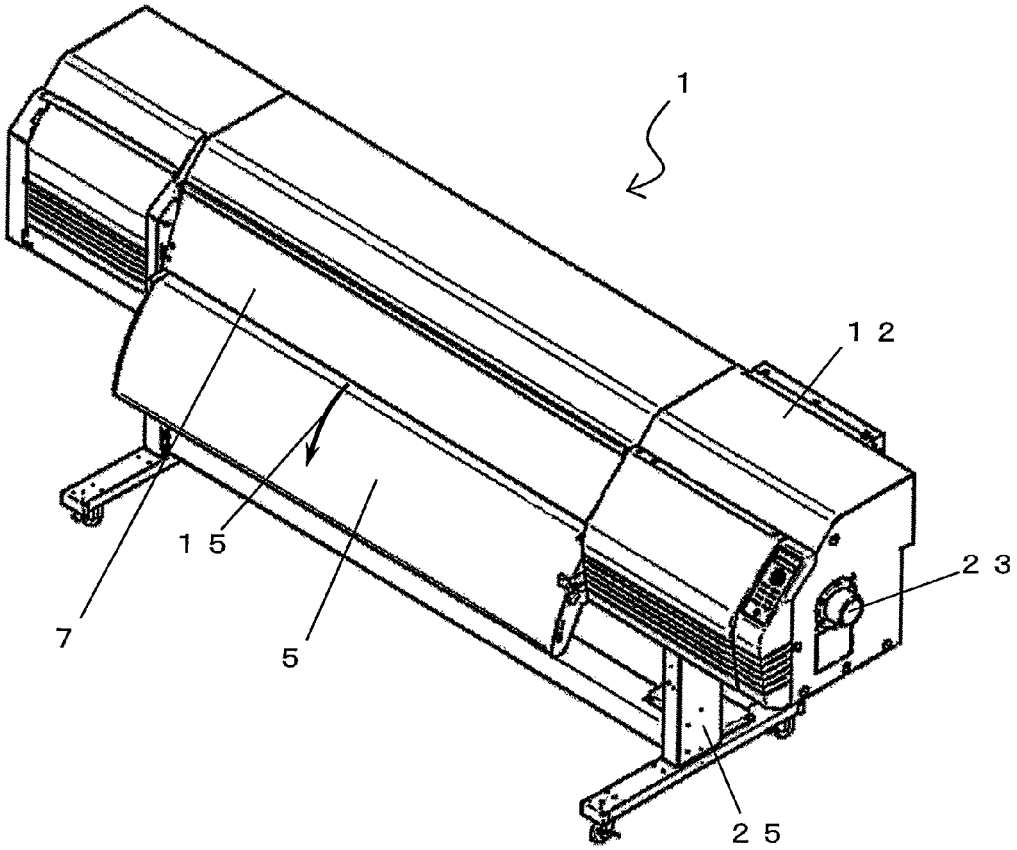
FIG. 3 is an external view of the inkjet printer.

FIG. 3 is an external view of the inkjet printer. In the inkjet printer 1, the housing 12 is supported by legs 25. The legs 25 are fixed to ends of a lower surface of the housing 12.

Figure 4:
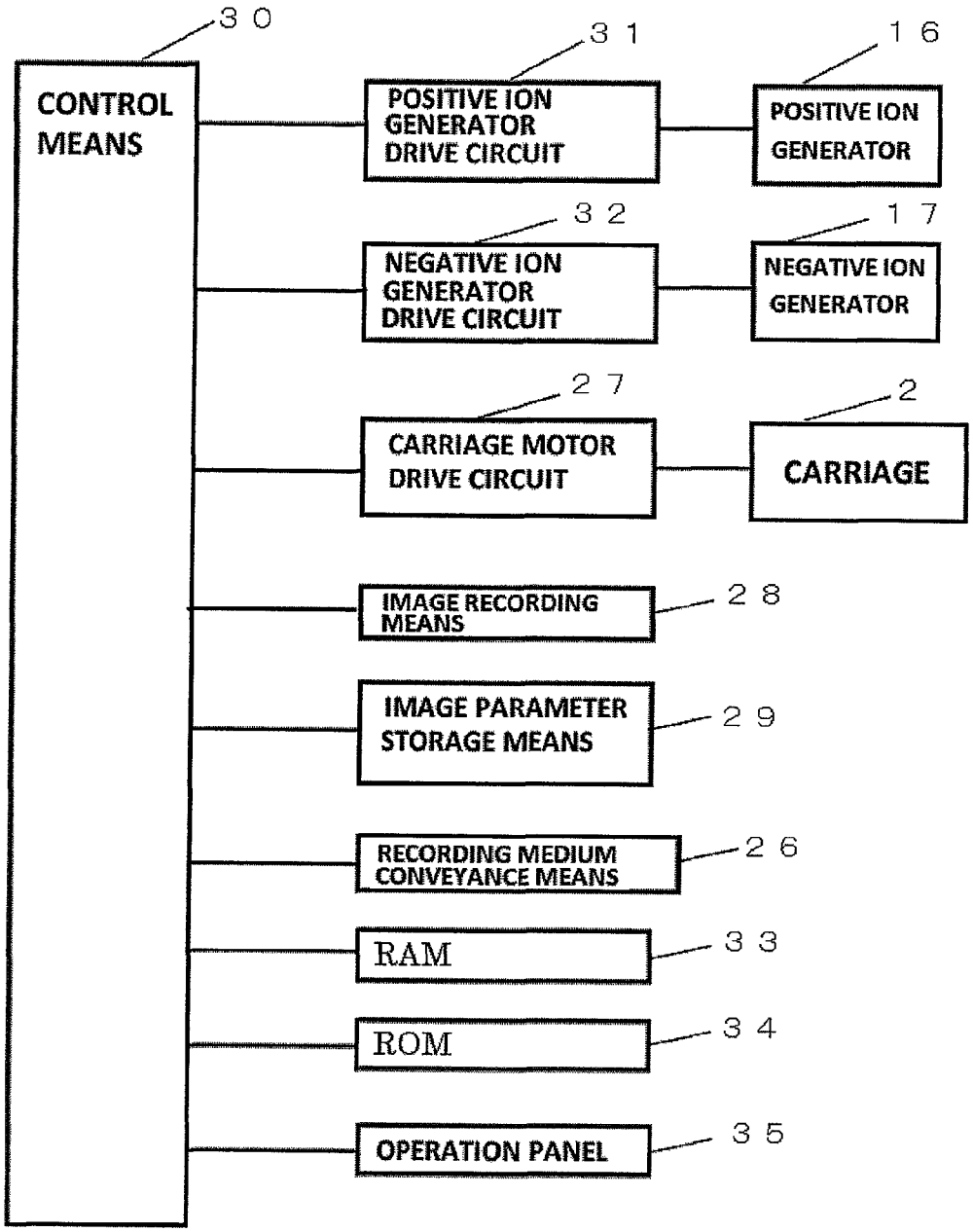
FIG. 4 is a block diagram of the inkjet printer.

FIG. 4 is a block diagram of the inkjet printer. Control means 30 performs overall control in accordance with a program stored in a ROM 34. The ROM 34 is a non-volatile memory for storing the program, an initial setting value, and the like. A RAM 33 is a RAM to function as a work area of the control means 30 and temporally store information, for example.

A positive ion generator drive circuit 31 drives a positive ion generator, namely, the first ionizer 16 based on the control of the control means 30. A negative ion generator drive circuit 32 drives a negative ion generator, namely, the second ionizer 17 based on the control of the control means 30. A carriage motor drive circuit 27 is a motor drive circuit for moving the carriage 2, and operates based on the control of the control means 30.

Recording medium conveyance means 26 is driven based on the control of the control means 30. The recording medium conveyance means 26 is means including the conveyance roller 6 and a motor for driving the conveyance roller 6, for conveying the recording medium. The amount of a single conveyance of the recording medium is determined based on the number of passes at the time of recording, which is stored in image parameter storage means 29.

The image parameter storage means 29 stores, for each recording mode, data necessary at the time of image recording, such as the number of recording passes, a setting value as to whether or not to turn the first ionizer 16 and the second ionizer 17 on or off, and the control means 30 operates based on the data and program. The recording mode is a combination of a movement speed of the carriage, the number of passes, an amount by which the recording medium is to be conveyed in a single conveyance, a specific moving direction of the carriage 2 in which recording is to be performed, the type of recording medium, and the like, which differ for each recording mode. For each combination, a parameter relating to how the first ionizer 16 and the second ionizer 17 are to be operated is determined in advance, and this parameter is stored in the image parameter storage means 29.

Image recording means 28 includes an inkjet recording head and a drive circuit therefor, and operates based on the control of the control means 30.

The first ionizer 16 and the second ionizer 17 operate under the control of the control means 30, and are controlled independently of each other. Further, the first ionizer 16 and the second ionizer 17 are controlled in a manner that corresponds to the operation of the recording medium conveyance means 26. The first ionizer 16 and the second ionizer 17 are controlled so that the positive ion and the negative ion can be supplied to the recording medium as evenly as possible. The first ionizer 16 and the second ionizer 17 may be controlled so that one of the ionizers is turned on while the other is turned off, and the amount of ions to be discharged from each of the ionizers can be easily controlled as necessary.

An operation panel 35 enables a user to, through his/her operation, make settings of various types of data and give an instruction to the control means 30, and is capable of displaying data. The input data is temporarily stored in the RAM 33.

Figure 5:
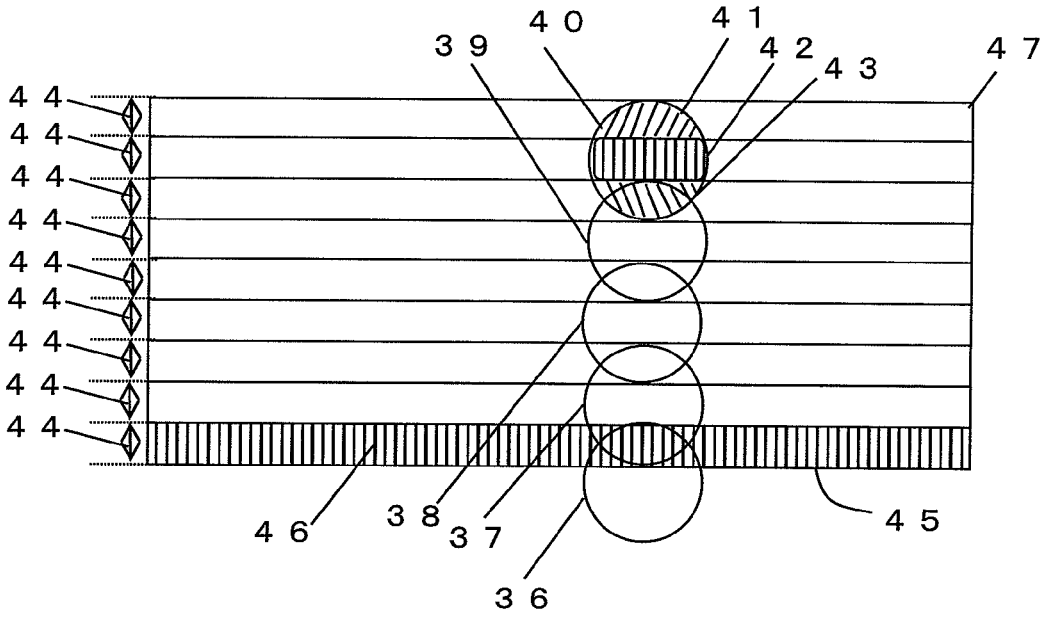
FIG. 5 is a diagram that is an illustration of a first example for illustrating an operation.
Figure 6:
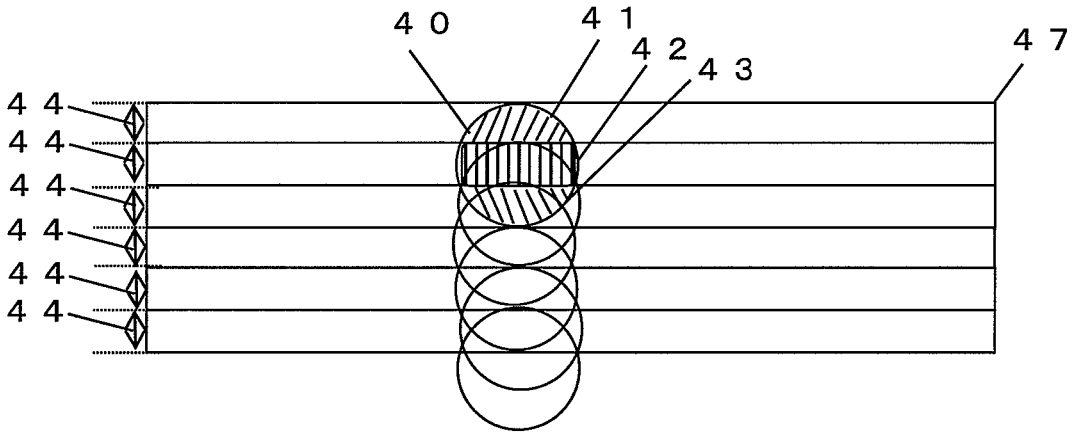
FIG. 6 is a diagram that is an illustration of a second example for illustrating another operation.

FIG. 5 is a diagram that is an illustration of a first example for illustrating an operation. FIG. 6 is a diagram that is an illustration of a second example for illustrating another operation. Those figures are each an illustration of a range in which the ions reach the recording medium 47. An amount of ions to reach the recording medium becomes smaller with an increasing distance from a source of generation. A description is given with the use of a circle as the reaching range for the sake of convenience. As an example, a circle 36 indicating the range in which the ions reach is formed of, for each conveyance amount 44 of the recording medium 47, a first area 41, a second area 42, and a third area 43. A description is given with the use of this example. A distance between the horizontal lines illustrated on the recording medium 47 indicates the conveyance amount 44 by which the recording medium 47 is to be conveyed in a single conveyance. The recording medium is conveyed by each conveyance amount 44 in each conveyance, the image is recorded on the recording medium, and the electricity is removed from the recording medium through the generation of ions.

For example, a portion of the recording medium 47 having a width corresponding to the conveyance amount 44 from a distal end side 45 of a given portion in the conveyance direction overlaps with the first area 41. At this time, the carriage 2 generates the ions while moving at a first predetermined speed. At the same time, the carriage 2 performs printing on the recording medium. In this case, the range in which the recording medium 47 is irradiated with the ions is a first irradiation range 46, which is indicated by the diagonal lines in the figure. When an amount of ions generated per unit time is fixed, the irradiation amount of ions is proportional to the movement speed of the carriage.

Next, the recording medium 47 is conveyed by the conveyance amount 44, and the carriage 2 to move next moves at the first predetermined speed. At the same time, the carriage 2 performs printing on the recording medium 47. However, the ions are not generated in this example. In other words, the first ionizer 16 and the second ionizer 17 are turned off.

Next, the recording medium 47 is conveyed by the conveyance amount 44, and a portion having a width corresponding to a triple of the conveyance amount 44 from the distal end side 45 of the given portion in the conveyance direction overlaps with the first area 41, the second area 42, and the third area 43. The carriage 2 generates the ions while moving at the first predetermined speed. At the same time, the carriage 2 performs printing on the recording medium 47. In this case, a range in which the recording medium 47 is irradiated with the ions covers scanning portions corresponding to the first area 41, the second area 42, and the third area 43, which includes the first irradiation range 46 indicated by the diagonal lines in the figure. The first irradiation range 46 is scanned twice.

In this manner, the ions are generated in every other scan to remove the electricity. The irradiation amount of ions to reach the recording medium tends to become smaller with an increasing distance from the electrodes. An amount of ions to reach the recording medium is large in the portion of the second area 42, and is small in the portions of the first area 41 and the third area 43. The amount of ions to reach the recording medium is made uniform by generating the ion a plurality of times from the first area 41 and the third area 43.

In FIG. 6, each time the recording medium 47 is conveyed, the carriage 2 moves at a second predetermined speed, generates the ions, and performs printing on the recording medium. In this case, the recording medium 47 is irradiated with the ions from the first area 41, the second area 42, and the third area 43.

Through the on/off control of the first ionizer 16 and the second ionizer 17 depending on the movement speed of the carriage 2, namely, on a time period in which the ions are generated, it is possible to suitably remove the static electricity, and to prevent the recording medium from being charged with electricity due to excessive generation of ions.

When the carriage 2 moves at a fast speed, the ions are generated in each scan of the carriage 2 as illustrated in FIG. 6, and when the carriage 2 moves at a slow speed, the ions are generated in every other scan of the carriage 2 as illustrated in FIG. 5. For example, when the speed of the carriage 2 in the example illustrated in FIG. 5 is twice as fast as the speed of the carriage 2 in the example illustrated in FIG. 6, the recording medium 47 is irradiated with nearly the same amount of ions.

The on/off control of the first ionizer 16 and the second ionizer 17 for each speed and scan of the carriage 2 is determined in advance for each of the recording modes having different recoding conditions, and is stored in the ROM 34. The recoding conditions include the speed of the carriage 2, the number of passes indicating a specific number of times of scans to complete the image, a scan direction for recording, the type of recording medium, and the like. Further, a specific scan in which the on/off control of the first ionizer 16 and the second ionizer 17 is to be performed is stored in association with those conditions. In particular, some types of recording media are easier to be charged with electricity, and for such a type of recording medium, it is necessary to perform control of lowering the carriage speed and turning the ionizers on in each scan. On the other hand, for a type of recording medium harder to be charged with electricity, it is necessary to perform control of increasing the carriage speed or reducing the times of scans with the ionizers being turned on. The concept is illustrated in the modelled examples of FIG. 5 and FIG. 6, but in an actual case, an experiment is conducted in advance so that a parameter for the on/off control of the first ionizer 16 and the second ionizer 17 that is optimal for each recording mode is determined to be used.

Figure 7:
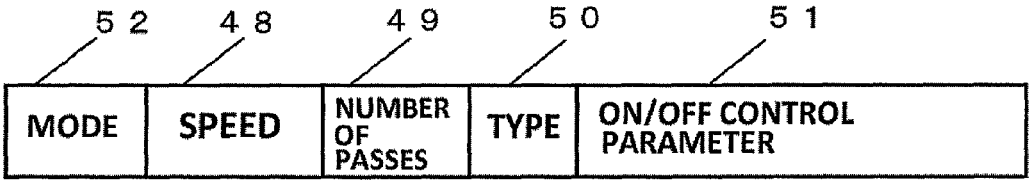
FIG. 7 is a diagram for illustrating an example of parameters to be stored.

FIG. 7 is a diagram for illustrating parameters to be stored. In the ROM 34, a mode 52 indicating the recording mode of printing, a speed 48 indicating the movement speed of the carriage 2, a number of passes 49 indicating the number of passes of recording, a type 50 indicating the type of recording medium, and an ON/OFF control parameter 51, which is data indicating whether to turn the first ionizer 16 and the second ionizer 17 on or off, are stored in association with one another.

Figure 8:
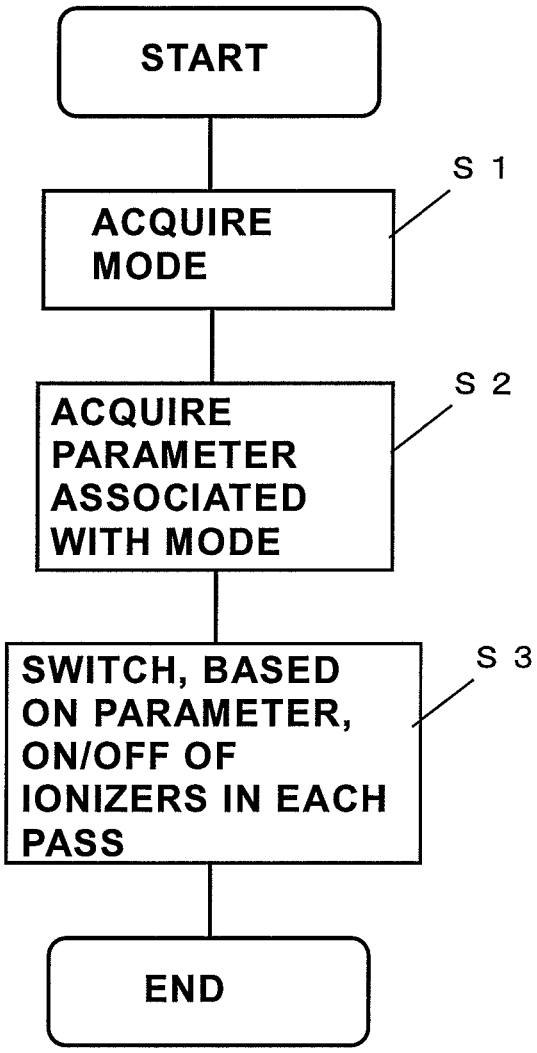
FIG. 8 is a flowchart of the operation.

FIG. 8 is a flowchart of the operation. The control means 30 performs various types of control in accordance with a program stored in the ROM 34. First, in Step S1, the control means 30 acquires a current printing mode. The current printing mode is temporarily stored in the RAM 33. The printing mode is selected through the user's input to the operation panel 35. Alternatively, the printing mode is attached to data on an image to be printed, and details of the attached printing mode are stored in the RAM 33.

Next, in Step S2, depending on the acquired printing mode, the control means 30 acquires, from the data stored in the image parameter storage means 29, the ON/OFF control parameter for controlling a corresponding ionizer. The image parameter storage means 29 may also use a predetermined recording area in the ROM 34.

Next, in Step S3, based on the ON/OFF control parameter in the acquired current printing mode, the control means 30 turns the first ionizer 16 and the second ionizer 17 on or off in each scan of the carriage.

In the manner described above, it is possible to easily optimize the ion supply amount per unit area of the recording medium depending on the printing mode. It is thus possible to prevent such problems that, due to a difference in ion supply amount per unit area, for example, the electricity is insufficiently removed because the ion supply amount is insufficient and the recording medium is charged with electricity because the ion supply amount is excessive. The inkjet printer has an optimal parameter of the ion supply amount that is associated with each of various printing modes of a printer and switches on/off of the ionizers in each scan of the carriage based on the parameter. In this manner, the ion supply amount per unit area of the object to be printed can be put in an optimal state.

Further, it is possible to easily control the generation of ions depending on the printing mode and to control the amount of generated ions depending on the conditions such as the number of passes, the type of recording medium, and the printing speed. A DC ionizer is used as the ionizer, and hence the ionizer is easy to be controlled. Further, the on/off control is performed in each scan, and hence the need to switch on/off of the ionizers quickly is eliminated. Therefore, it is easy to perform the control, and it is possible to irradiate the recording medium with the generated ions at a nearly uniform concentration.

Figure 9:
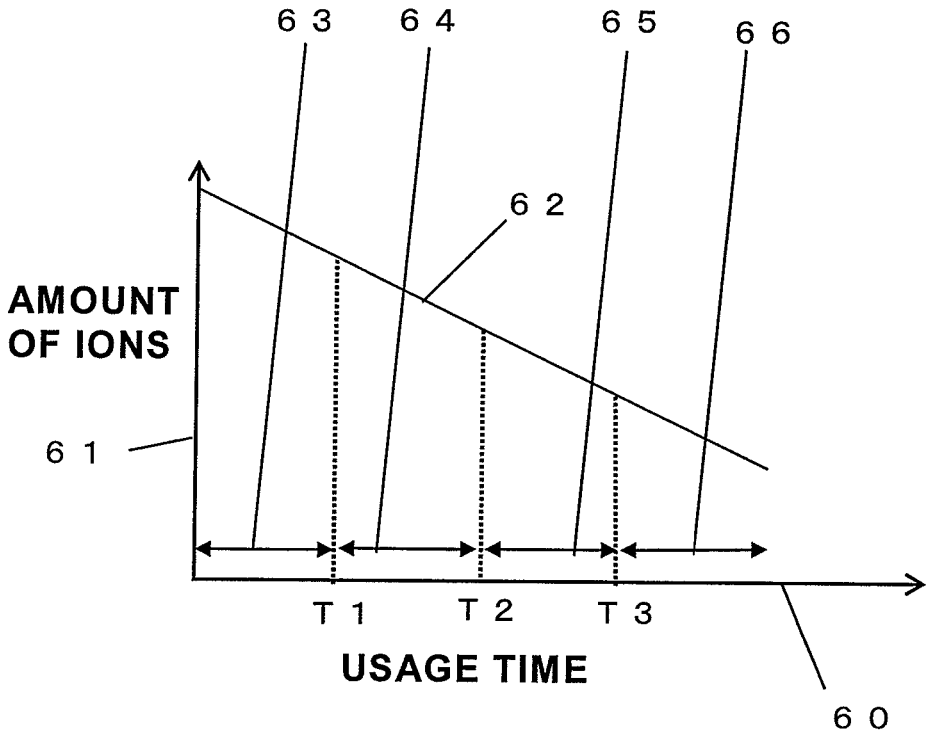
FIG. 9 is a graph for showing deterioration of an ionizer.

FIG. 9 is a graph for showing deterioration of the ionizer. FIG. 9 is a graph in which an X-axis represents a usage time 60 of one of the first ionizer 16 and the second ionizer 17 and a Y-axis represents an amount of ions 61 generated from the ionizer. As indicated by a line 62, the first ionizer 16 and the second ionizer 17 each have such a characteristic that as the usage time of the ionizer becomes longer, the amount of ions generated from the ionizer decreases. A usage time that has elapsed since the start of use until T1 is defined as a first period 63, a period from T1 to T2 is defined as a second period 64, a period from T2 to T3 is defined as a third period 65, and a period after T3 is defined as a fourth period 66. Each of the first ionizer 16 and the second ionizer 17 is set so as to reach its usage limit at around T3. For example, when T3 is to be determined, time when the ionizer has deteriorated by a predetermined degree of deterioration, such as 50%, may be set as the usage limit. Further, the usage limit may be determined depending on the recording medium to be used. When the usage time passes T3, the ionizer generates a smaller number of ions and the efficient deteriorates, and hence it is preferred not to use the ionizer any longer. Further, in the fourth period, the ionizer may be used continuously without an end of its operation being determined. However, in that case, the ionizer is used with recognition of a possibility that because the amount of generated ions is small, the ion can no longer be applied as intended and thus intended performance cannot be exerted. When the ionizer is used in such a manner, it is preferred that a notification function such as displaying an alert on a display be provided.

Further, the ionizer for generating the positive ion and the ionizer for generating the negative ion may not have the same relationship between the usage time and the amount of generated ions, and hence it is preferred that in consideration of the characteristic of each of the ionizers, each of the ionizers be controlled with a period corresponding to the degree of deterioration being determined. Further, in the above-mentioned example, the ionizers are controlled with the periods being determined, but a function of the usage time and the degree of deterioration may be acquired in advance so that an irradiation rate is controlled based on the degree of deterioration, which is determined based on an actually measured usage time and the function. In this manner, it is possible to apply the ions more accurately.

FIG. 10 is a table for showing the irradiation rate corresponding to each type of recording medium. When the ion is applied to the recording medium, an optimum irradiation amount varies depending on the type of recording medium to be used. In order to maintain this optimum irradiation amount, it is necessary to take into consideration the amount of ions generated from each of the first ionizer 16 and the second ionizer 17, which decreases as the usage time of the ionizer passes. For example, a relationship between the type of recording medium and the irradiation rate of ions that is determined depending on the usage time is stored in the ROM 34 as a table, and such control is performed that when the type of recording medium is input, the corresponding irradiation rate can be calculated. This control can be realized by the control means 30 counting the usage time of each of the first ionizer 16 and the second ionizer 17.

In the table shown in FIG. 10, a medium A has irradiation rates of 0.7, 0.8, 0.9, and 1.0 in the first period 63, the second period 64, the third period 65, and the fourth period 66, respectively. This value is a value proportional to an irradiation amount. For example, when the value of the irradiation rate is 0.7, this value indicates an irradiation amount of 70%, and when the value of the irradiation rate is 0.8, this value indicates an irradiation amount of 80%. When the value of the irradiation rate is 1.0, this value indicates an irradiation amount of 100%. This irradiation amount may be controlled depending on the length of time of irradiation. A medium B has irradiation rates of 0.4, 0.6, 0.8, and 1.0 in the first period 63, the second period 64, the third period 65, and the fourth period 66, respectively. A medium C has irradiation rates of 0.6, 0.75, 0.9, and 1.0 in the first period 63, the second period 64, the third period 65, and the fourth period 66, respectively.

The control means 30 includes input means and time measurement means, to thereby individually measure the usage time of each of the first ionizer 16 and the second ionizer 17. Moreover, the control means 30 stores in advance the table associating the usage time with the irradiation rate for each recording medium. Through the use of the type of recording medium input from the input means and the usage time of the ionizer and based on the table, the control means 30 calculates the irradiation rate corresponding to the input recording medium. Then, the control means 30 controls the ion irradiation based on the thus calculated irradiation rate.

The table is determined in advance so that the irradiation rate is optimum for each combination of the type of recording medium and the usage time. It is possible to facilitate control such as calculation processing by storing the table and calculating the irradiation rate based on the stored table. Further, instead of using the table, the control means 30 may store a function so as to alternatively perform processing of calculating the degree of deterioration and the irradiation rate based on the usage time. More accurate control is performed with this configuration, but a calculation amount may increase.

Further, it is preferred that when the usage time reaches the fourth period 66, namely, the usage time exceeds T3, an alert for prompting replacement of the first ionizer 16 and the second ionizer 17 be issued. This is because although the ionizer at least operates even when applying the ions continuously at the irradiation rate of 100%, the effect of irradiation may be insufficient because the amount of generated ions is small.

INDUSTRIAL APPLICABILITY

The present invention is applicable to an inkjet printer.

REFERENCE SIGNS LIST

1 inkjet printer
2 carriage
3 platen
4 rear paper guide
5 front paper guide
6 conveyance roller
7 cover
8 rail
9 duct
10 exhaust port
11 carriage-suction fan
12 housing
13 housing-suction fan
16 first ionizer
17 second ionizer

The invention claimed is:

1. An inkjet printer for changing, depending on a plurality of printing modes, a conveyance amount and a carriage speed of a recording medium to be conveyed intermittently, ejecting ink from a recording head, and recording an image onto the recording medium, the inkjet printer comprising:

the recording head for ejecting the ink to the recording medium from a plurality of nozzles;

a conveyance device for conveying the recording medium;

a carriage having the recording head mounted therein, the carriage being reciprocable in a direction intersecting with a conveyance direction of the recording medium;

a platen arranged so as to be opposed to a surface of the recording head on which the plurality of nozzles are arranged, for holding the recording medium being conveyed by the conveyance device;

a housing having at least the platen and the carriage accommodated therein;

a first ionizer for generating a positive ion;

a second ionizer for generating a negative ion;

a first drive circuit for driving the first ionizer;

a second drive circuit for driving the second ionizer;

a controller for controlling the first drive circuit and the second drive circuit;

a storage device for storing a plurality of parameters respectively for the plurality of print modes, each of the plurality of parameters being for supporting an on operation and an off operation of each of the first ionizer and the second ionizer in association with a corresponding one of the plurality of the printing modes;

a housing-suction device arranged on a rear surface side of the housing, for sucking a gas from an outside to an inside of the housing;

a front paper guide provided on a downstream side of the platen in the conveyance direction, for guiding the recording medium onto which the images has been recorded; and a cover arranged so that a distal end thereof is located at a distance from the front paper guide, the distal end being located lower in a vertical direction than the surface of the recording head on which the plurality of nozzles are arranged, the cover being connected to the housing so as to be rotatable, wherein the first drive circuit and the second drive circuit are controlled by the control means independently of each other, wherein the controller acquires one of the plurality of printing modes of the inkjet printer, acquires a corresponding one of the plurality of parameters associated with the acquired printing mode from the storage device, and controls, based on the acquired parameter, in each scan of the carriage, the on operation and the off operation of the first ionizer and the second ionizer, wherein the cover is arranged so as to approach the front paper guide toward the distal end, wherein the front paper guide is curved in the vertical direction, and wherein a part of the gas sucked by the housing-suction device is discharged from a portion between the front paper guide and the cover.

2. An inkjet printer according to claim 1, wherein on a side surface of the carriage being reciprocable in a moving direction of the carriage, the first ionizer and the second ionizer are arranged at a distance from each other along the conveyance direction of the recording medium, and the first ionizer and the second ionizer have openings from which ions are to be discharged, the openings being formed so as to face toward the platen side.

3. An inkjet printer according to claim 1, wherein the carriage comprises:

a duct arranged to protrude toward the housing-suction means, the duct comprising carriage-suction means for sucking, into the carriage, the gas sucked by the housing-suction means, the carriage-suction means being arranged at a distal end of the protruding portion of the duct so as to be opposed to the housing-suction means device; and an exhaust port with an elongated hole shape formed along the moving direction in a lower portion of a front surface of the carriage on the downstream side in the conveyance direction, wherein the gas sucked by the housing-suction means is separated into the gas flowing inside the carriage through the carriage-suction means, and the gas flowing outside the carriage, and wherein the gas discharged through the exhaust port is discharged toward the cover, and also discharged to an outside of the housing while mixed with the gas flowing outside the carriage.

4. An inkjet printer for changing, depending on a plurality of printing modes, a conveyance amount and a carriage speed of a recording medium to be conveyed intermittently, ejecting ink from a recording head, and recording an image onto the recording medium, the inkjet printer comprising:

the recording head for ejecting the ink to the recording medium from a plurality of nozzles;

a conveyance device for conveying the recording medium;

a carriage having the recording head mounted therein, the carriage being reciprocable in a direction intersecting with a conveyance direction of the recording medium;

a platen arranged so as to be opposed to a surface of the recording head on which the plurality of nozzles are arranged, for holding the recording medium being conveyed by the conveyance device;

a housing having at least the platen and the carriage accommodated therein;

a first ionizer for generating a positive ion;

a second ionizer for generating a negative ion;

first drive circuit for driving the first ionizer;

a second drive circuit for driving the second ionizer;

a controller for controlling the first drive circuit and the second drive circuit; and a storage device for storing a plurality of parameters respectively for the plurality of print modes, each of the plurality of parameters being for supporting an on operation and an off operation of each of the first ionizer and the second ionizer in association with a corresponding one of the plurality of printing modes, wherein the first drive circuit and the second drive circuit are controlled by the control means independently of each other, wherein the controller acquires one of the plurality of printing modes of the inkjet printer acquires a corresponding one of the plurality of parameters associated with the acquired printing mode from the storage device, and controls, based on the acquired parameter, in each scan of the carriage, the operation and the off operation of the first ionizer and the second ionizer, wherein the controller comprises a measurement device for measuring a usage time of each of the first ionizer and the second ionizer, wherein the storage device stores, in advance, the usage time and an amount of ions generated from the first ionizer in association with each other and stores, in advance, the usage time and an amount of ions generated from the second ionizer in association with each other, and wherein depending on the usage times, the control means generates the ions from the first ionizer and the second ionizer and controls an amount of ions to be applied to the recording medium.

5. An inkjet printer according to claim 4, wherein on a side surface of the carriage being reciprocable in a moving direction of the carriage, the first ionizer and the second ionizer are arranged at a distance from each other along the conveyance direction of the recording medium, and the first ionizer and the second ionizer have openings from which ions are to be discharged, the openings being formed so as to face toward the platen side.

6. An inkjet printer for changing, depending on a plurality of printing modes, a conveyance amount and a carriage speed of a recording medium to be conveyed intermittently, ejecting ink from a recording head, and recording an image onto the recording medium, the inkjet printer comprising:

the recording head for ejecting the ink to the recording medium from a plurality of nozzles;

a conveyance device for conveying the recording medium;

a carriage having the recording head mounted therein, the carriage being reciprocable in a direction intersecting with a conveyance direction of the recording medium;

a platen arranged so as to be opposed to a surface of the recording head on which the plurality of nozzles are arranged, for holding the recording medium being conveyed by the conveyance device;

a housing having at least the platen and the carriage accommodated therein;

a first ionizer for generating a positive ion;

a second ionizer for generating a negative ion;

first drive circuit for driving the first ionizer;

a second drive circuit for driving the second ionizer;

a controller for controlling the first drive circuit and the second drive circuit;

a storage device for storing a plurality of parameters respectively for the plurality of print modes, each of the plurality of parameters being for supporting an on operation and an off operation of each of the first ionizer and the second ionizer in association with a corresponding one of the plurality of printing modes; and an input device for inputting a type of the recording medium to be used, wherein the first drive circuit and the second drive circuit are controlled by the control means independently of each other, wherein the controller acquires one of the plurality of printing modes of the inkjet printer, acquires a corresponding one of the plurality of parameters associated with the acquired printing mode from the storage device, and controls, based on the acquired parameter, in each scan of the carriage, the on operation and the off operation of the first ionizer and the second ionizer, wherein the storage device stores, in advance, the type of the recording medium and an amount of ions generated from the first ionizer in association with each other and stores, in advance, the type of the recording medium and an amount of ions generated from the second ionizer in association with each other, and wherein depending on the type of the recording medium input from the input device, the controller generates the ions from the first ionizer and the second ionizer and controls an amount of ions to be applied to the recording medium.

7. An inkjet printer according to claim 6, wherein on a side surface of the carriage being reciprocable in a moving direction of the carriage, the first ionizer and the second ionizer are arranged at a distance from each other along the conveyance direction of the recording medium, and the first ionizer and the second ionizer have openings from which ions are to be discharged, the openings being formed so as to face toward the platen side.

8. An inkjet printer for changing, depending on a plurality of printing modes, a conveyance amount and a carriage speed of a recording medium to be conveyed intermittently, ejecting ink from a recording head, and recording an image onto the recording medium, the inkjet printer comprising:

the recording head for ejecting the ink to the recording medium from a plurality of nozzles;

a conveyance device for conveying the recording medium;

a carriage having the recording head mounted therein, the carriage being reciprocable in a direction intersecting with a conveyance direction of the recording medium;

a platen arranged so as to be opposed to a surface of the recording head on which the plurality of nozzles are arranged, for holding the recording medium being conveyed by the conveyance device;

a housing having at least the platen and the carriage accommodated therein;

a first ionizer for generating a positive ion;

a second ionizer for generating a negative ion;

a first drive circuit for driving the first ionizer;

a second drive circuit for driving the second ionizer;

a controller for controlling the first drive circuit and the second drive circuit;

a storage device for storing a parameter for supporting an on operation and an off operation of each of the first ionizer and the second ionizer in association with the printing modes, a housing-suction device arranged on a rear surface side of the housing, for sucking a gas from an outside to an inside of the housing;

a front paper guide provided on a downstream side of the platen in the conveyance direction, for guiding the recording medium onto which the image has been recorded; and a cover arranged so that a distal end thereof is located at a distance from the front paper guide, the distal end being located lower in a vertical direction than the surface of the recording head on which the plurality of nozzles are arranged, the cover being connected to the housing so as to be rotatable, wherein the first drive circuit and the second drive circuit are controlled by the control means independently of each other, wherein the controller acquires the printing mode of the inkjet printer, acquires the parameter associated with the acquired printing mode from the storage device, and controls, based on the acquired parameter, in each scan of the carriage, the on operation and the off operation of the first ionizer and the second ionizer, wherein the cover is arranged so as to approach the front paper guide toward the distal end, wherein the front paper guide is curved in the vertical direction, and wherein a part of the gas sucked by the housing- suction device is discharged from a portion between the front paper guide and the cover.

9. An inkjet printer according to claim 8, wherein on a side surface of the carriage being reciprocable in a moving direction of the carriage, the first ionizer and the second ionizer are arranged at a distance from each other along the conveyance direction of the recording medium, and the first ionizer and the second ionizer have openings from which ions are to be discharged, the openings being formed so as to face toward the platen side.

10. An inkjet printer according to claim 8, wherein the carriage comprises:

a duct arranged to protrude toward the housing- suction means, the duct comprising a carriage-suction device for sucking, into the carriage, the gas sucked by the housing-suction device, the carriage-suction device being arranged at a distal end of the protruding portion of the duct so as to be opposed to the housing-suction device; and an exhaust port with an elongated hole shape formed along the moving direction in a lower portion of a front surf ace of the carriage on the downstream side in the conveyance direction, wherein the gas sucked by the housing-suction device is separated into the gas flowing inside the carriage through the carriage-suction device, and the gas flowing outside the carriage, and wherein the gas discharged through the exhaust port is discharged toward the cover, and also discharged to an outside of the housing while mixed with the gas flowing outside the carriage.

11. An inkjet printer for changing, depending on a plurality of printing modes, a conveyance amount and a carriage speed of a recording medium to be conveyed intermittently, ejecting ink from a recording head, and recording an image onto the recording medium, the inkjet printer comprising:

the recording head for ejecting the ink to the recording medium from a plurality of nozzles;

a conveyance device for conveying the recording medium;

a carriage having the recording head mounted therein, the carriage being reciprocable in a direction intersecting with a conveyance direction of the recording medium;

a platen arranged so as to be opposed to a surface of the recording head on which the plurality of nozzles are arranged, for holding the recording medium being conveyed by the conveyance device;

a housing having at least the platen and the carriage accommodated therein;

a first ionizer for generating a positive ion;

a second ionizer for generating a negative ion;

a first drive circuit for driving the first ionizer;

a second drive circuit for driving the second ionizer;

a controller for controlling the first drive circuit and the second drive circuit; and a storage device for storing a parameter for supporting an on operation and an off operation of each of the first ionizer and the second ionizer in association with the printing modes, wherein the first drive circuit and the second drive circuit are controlled by the control means independently of each other, wherein the controller acquires the printing mode of the inkjet printer, acquires the parameter associated with the acquired printing mode from the storage device, and controls, based on the acquired parameter, in each scan of the carriage, the on operation and the off operation of the first ionizer and the second ionizer, wherein the controller comprises a measurement device for measuring a usage time of each of the first ionizer and the second ionizer, wherein the storage device stores, in advance, the usage time and an amount of ions generated from the first ionizer in association with each other and stores, in advance, the usage time and an amount of ions generated from the second ionizer in association with each other, and wherein depending on the usage times, the controller generates the ions from the first ionizer and the second ionizer and controls an amount of ions to be applied to the recording medium.

12. An inkjet printer according to claim 11, wherein on a side surface of the carriage being reciprocable in a moving direction of the carriage, the first ionizer and the second ionizer are arranged at a distance from each other along the conveyance direction of the recording medium, and the first ionizer and the second ionizer have openings from which ions are to be discharged, the openings being formed so as to face toward the platen side.

13. An inkjet printer for changing, depending on a plurality of printing modes, a conveyance amount and a carriage speed of a recording medium to be conveyed intermittently, ejecting ink from a recording head, and recording an image onto the recording medium, the inkjet printer comprising:

the recording head for ejecting the ink to the recording medium from a plurality of nozzles;

a conveyance device for conveying the recording medium;

a carriage having the recording head mounted therein, the carriage being reciprocable in a direction intersecting with a conveyance direction of the recording medium;

a platen arranged so as to be opposed to a surface of the recording head on which the plurality of nozzles are arranged, for holding the recording medium being conveyed by the conveyance device;

a housing having at least the platen and the carriage accommodated therein;

a first ionizer for generating a positive ion;

a second ionizer for generating a negative ion;

a first drive circuit for driving the first ionizer;

a second drive circuit for driving the second ionizer;

a controller for controlling the first drive circuit and the second drive circuit;

a storage device for storing a parameter for supporting an on operation and an off operation of each of the first ionizer and the second ionizer in association with the printing modes; and an input device for inputting a type of the recording medium to be used, wherein the first drive circuit and the second drive circuit are controlled by the control means independently of each other, wherein the controller acquires the printing mode of the inkjet printer, acquires the parameter associated with the acquired printing mode from the storage device, and controls, based on the acquired parameter, in each scan of the carriage, the on operation and the off operation of the first ionizer and the second ionizer, wherein the storage device stores, in advance, the type of the recording medium and an amount of ions generated from the first ionizer in association with each other and stores, in advance, the type of the recording medium and an amount of ions generated from the second ionizer in association with each other, and wherein depending on the type of the recording medium input from the input device, the controller generates the ions from the first ionizer and the second ionizer and controls an amount of ions to be applied to the recording medium.

14. An inkjet printer according to claim 13, wherein on a side surface of the carriage being reciprocable in a moving direction of the carriage, the first ionizer and the second ionizer are arranged at a distance from each other along the conveyance direction of the recording medium, and the first ionizer and the second ionizer have openings from which ions are to be discharged, the openings being formed so as to face toward the platen side.

* * * * *